US005680902A

United States Patent [19]

Giroux et al.

[11] Patent Number: 5,680,902

[45] Date of Patent: Oct. 28, 1997

[54] WELLBORE VALVE

[75] Inventors: Richard L. Giroux, Katy, Tex.; Peter Budde, Vlaardingen, Netherlands

[73] Assignee: Weatherford/Lamb, Inc., Houston, Tex.

[21] Appl. No.: 639,886

[22] Filed: Apr. 29, 1996

Related U.S. Application Data

[63] Continuation-in-part of Ser. No. 519,503, Aug. 25, 1995, Pat. No. 5,511,618, which is a continuation of Ser. No. 283,404, Aug. 1, 1994, Pat. No. 5,450,903.

[30] Foreign Application Priority Data

Mar. 22, 1994 [GB] United Kingdom ..... 9405679

[51] Int. Cl.[6] ..... E21B 34/10

[52] U.S. Cl. ..... 166/321; 166/327

[58] Field of Search ..... 166/319, 321, 166/324, 327, 242.8

[56] References Cited

U.S. PATENT DOCUMENTS

| | | | |
|---|---|---|---|
| 1,490,848 | 4/1924 | Pettit | 137/519.5 |
| 1,577,740 | 3/1926 | Macomber et al. | 137/519.5 |
| 1,700,603 | 1/1929 | Vreeland et al. | 137/519.5 |
| 1,863,613 | 6/1932 | Burt . | |
| 1,872,855 | 8/1932 | Walker | 166/153 |
| 1,875,414 | 9/1932 | Burt . | |
| 1,875,613 | 6/1932 | Burt . | |
| 1,882,314 | 10/1932 | Burt | 166/328 |
| 1,906,312 | 5/1933 | Burt | 137/533.11 |
| 2,075,882 | 4/1937 | Bradtly | 166/21 |
| 2,104,270 | 1/1938 | Owsley | 166/1 |
| 2,162,261 | 6/1939 | Layne | 166/21 |
| 2,309,839 | 2/1943 | Gardner | 137/519.5 |
| 2,320,670 | 6/1943 | Scaramucci | 166/328 |
| 2,627,314 | 2/1953 | Baker et al. | 166/1 |
| 2,630,179 | 3/1953 | Brown | 166/14 |
| 2,654,435 | 10/1953 | Oliver | 166/4 |

(List continued on next page.)

OTHER PUBLICATIONS

"1982–83 Products & Services Catalog," Weatherford Int'l, pp. 39–43.
"Float Equipment by Weatherford," Weatherfrod Oil Tool Co., Ltd.
"Used Float Shoe Recovered And Tested," Colvard, 10 Feb. 86 Oil & Gas Journal.
"Flow Loop Endurance Tests Compare Float Performance," Stringfellow, 10 Feb. 86 Oil & Gas Journal.
"Tests Find hammering, Fluid, Cutting, Erosion Cause Float Shoe Failure," Stringfellow, 21 Jan. 85 Oil & Gas Journal.
"Product Catalog Oilfield Service Solutions," Weatherford Int'l, paticularly pp. 15–17, 1992.
"Conventioanlized and Specialized Float Equipment," Weatherfrod Int'l, 1985.
Weatherford, "Cementing Program," 1986.
Weatherford, "General Services And Products Catalog," 1990–91.
Weatherford, "AF–SURE–SEAL Technical Bulletin HOU, 123–001," 1986.
Weatherford, "Model 820 Float Valves Technical Bulletin HOU 115–001," 1984.
Weatherford, "Model 457 Float Valves Technical Bulletin HOU 114–001," 1984.
Davis–Lynch, Inc. "In Floating And Cementing Equipment," 1984–85.
Baker–Packers, "Bakerline Float Equipment & Cementing Aids," 1989.
Trico Industries, Inc., "1982–1983 catalog," 1982.
Baker Oil Tools, "Primary Cementing," 1989.
Baker Oil Tools, Inc., "Bakerline Stage And Stab–In Cementing Equipment And Services," 1982.

*Primary Examiner*—Roger J. Schoeppel
*Attorney, Agent, or Firm*—Guy McClung

[57] ABSTRACT

A fill valve includes a tubular housing which accommodates a valve member which is biased toward a closed position by a light spring. The valve member includes a head and a tubular portion which is provided with two large windows. When the fill valve is open fluid flows freely through the tubular portion of the fill valve and out of the windows.

13 Claims, 11 Drawing Sheets

U.S. PATENT DOCUMENTS

| | | | |
|---|---|---|---|
| 2,724,443 | 11/1955 | Baker . | |
| 2,748,873 | 6/1956 | Baker et al. | 166/327 X |
| 2,756,828 | 7/1956 | Daily | 166/164 |
| 2,802,482 | 8/1957 | Arnhold . | |
| 2,884,938 | 5/1959 | Hildebrandt | 137/68 |
| 2,935,131 | 5/1960 | McCune | 166/45 |
| 3,006,415 | 10/1961 | Burns et al. | 166/156 |
| 3,062,296 | 11/1962 | Brown | 166/225 |
| 3,102,595 | 9/1963 | Fisher et al. | 166/156 |
| 3,105,378 | 10/1963 | Darling | 73/40.5 |
| 3,153,451 | 10/1964 | Chancellor et al. | 166/51 |
| 3,159,219 | 12/1964 | Scott | 166/156 |
| 3,273,650 | 9/1966 | Alexander et al. | 166/327 X |
| 3,332,499 | 7/1967 | Harris et al. | 166/242 |
| 3,385,370 | 5/1968 | Knox et al. | 166/225 |
| 3,385,372 | 5/1968 | Knox | 166/225 |
| 3,545,543 | 12/1970 | Kammerer, Jr. et al. | 166/212 |
| 3,581,817 | 6/1971 | Kammerer, Jr. | 166/208 |
| 3,759,281 | 9/1973 | Falcuta | 137/519.5 |
| 3,768,556 | 10/1973 | Baker | 166/154 |
| 3,770,001 | 11/1973 | Davis | 137/533.11 |
| 3,776,250 | 12/1973 | Knox | 137/71 |
| 3,776,258 | 12/1973 | Dockins, Jr. | 137/519.5 |
| 3,967,680 | 7/1976 | Jeter | 166/325 X |
| 4,067,358 | 1/1978 | Streich | 137/624.13 |
| 4,082,104 | 4/1978 | Keeney | 137/71 |
| 4,413,682 | 11/1983 | Callihan et al. | 166/382 |
| 4,429,746 | 2/1984 | Allard | 166/291 |
| 4,442,894 | 4/1984 | Callihan et al. | 166/328 X |
| 4,474,241 | 10/1984 | Freeman | 166/317 |
| 4,487,263 | 12/1984 | Jani | 166/289 |
| 4,488,566 | 12/1984 | Hicks | 137/74 |
| 4,515,218 | 5/1985 | Bissonnette | 166/328 |
| 4,589,495 | 5/1986 | Langer et al. | 166/383 |
| 4,603,710 | 8/1986 | Tiefenthaler | 137/514.7 |
| 4,624,316 | 11/1986 | Baldridge et al. | 166/325 |
| 4,625,755 | 12/1986 | Reddoch | 166/325 X |
| 4,625,762 | 12/1986 | Hasanzdeh et al. | 137/624.27 |
| 4,655,247 | 4/1987 | Westra et al. | 137/519.5 |
| 4,674,569 | 6/1987 | Revils et al. | 166/154 |
| 4,687,019 | 8/1987 | Mayfield | 137/375 |
| 4,711,300 | 12/1987 | Wardlaw III et al. | 166/153 |
| 4,712,619 | 12/1987 | Stepp et al. | 166/327 |
| 4,825,947 | 5/1989 | Mikolajczyk | 166/241 |
| 4,872,510 | 10/1989 | Lehr et al. | 166/327 |
| 4,945,947 | 8/1990 | Westra | 137/519.5 |
| 4,955,949 | 9/1990 | Bailey et al. | 166/325 X |
| 4,962,819 | 10/1990 | Bailey et al. | 166/325 X |
| 4,979,562 | 12/1990 | Langer | 166/242 |
| 5,178,184 | 1/1993 | Skillman | 137/533.13 |
| 5,228,518 | 7/1993 | Wilson et al. | 166/369 |
| 5,261,488 | 11/1993 | Gullet et al. | 166/241.7 |
| 5,450,903 | 9/1995 | Budde | 166/321 |
| 5,515,618 | 5/1996 | Budde | 166/321 |

FIG. 12
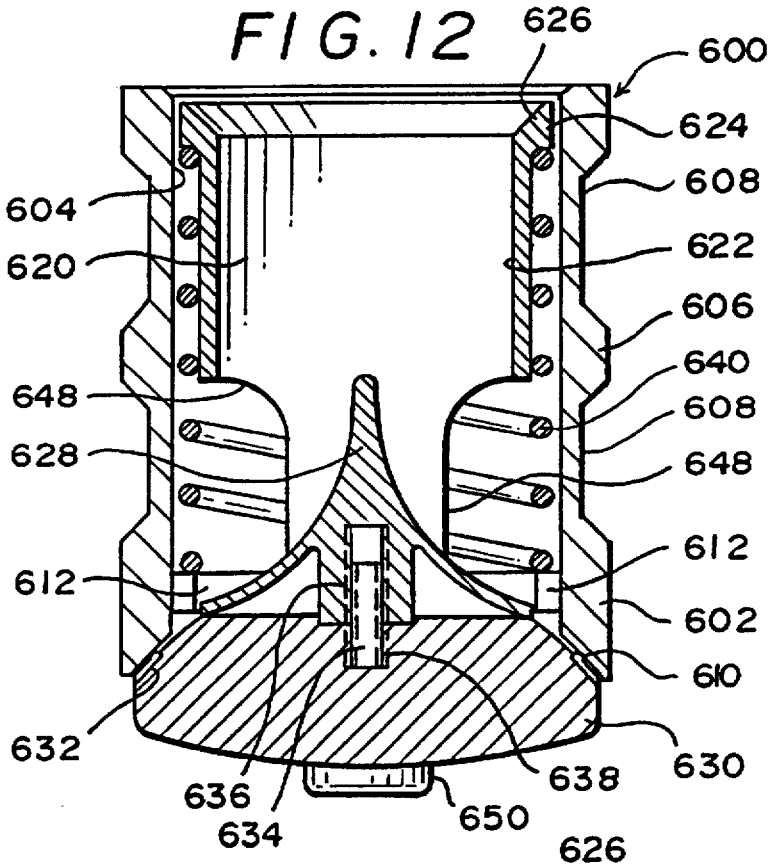
FIG. 13A
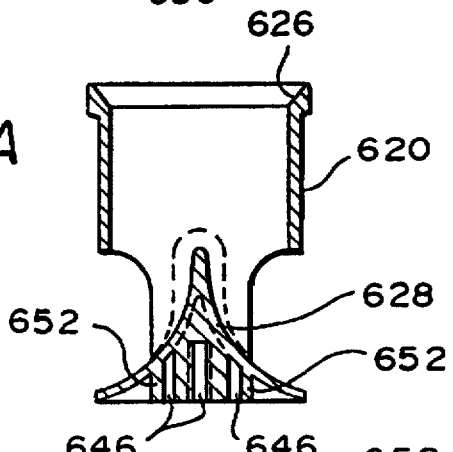
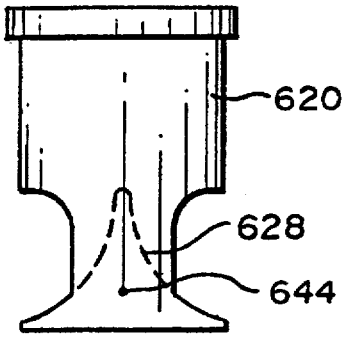
FIG. 13B
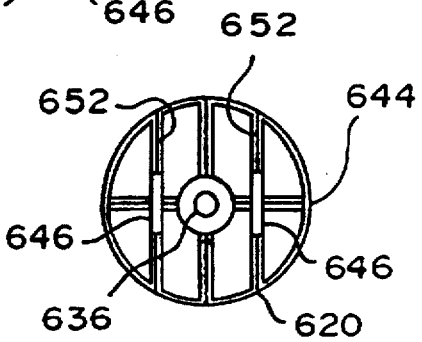
FIG. 13C

FIG. 14A
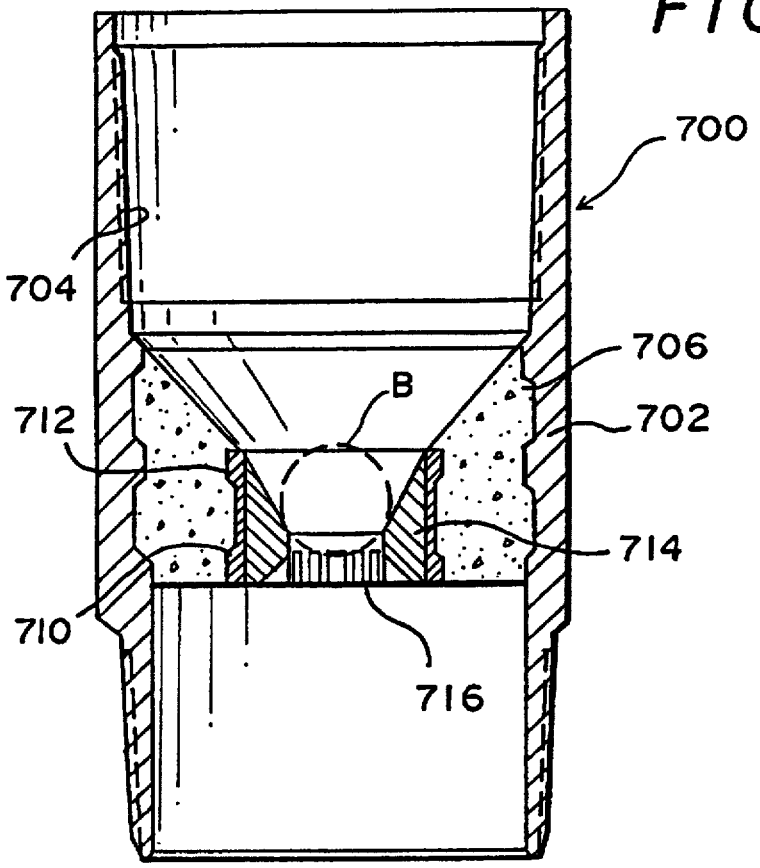
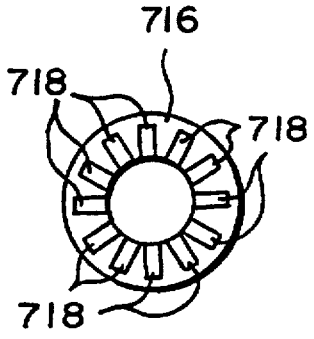
FIG. 14B
FIG. 15B
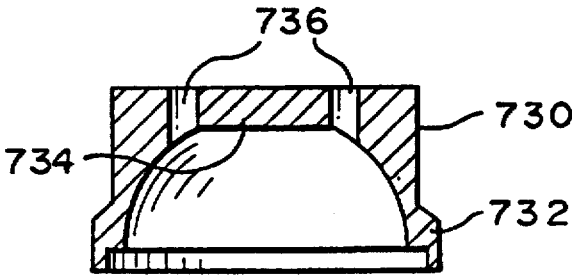
FIG. 15A
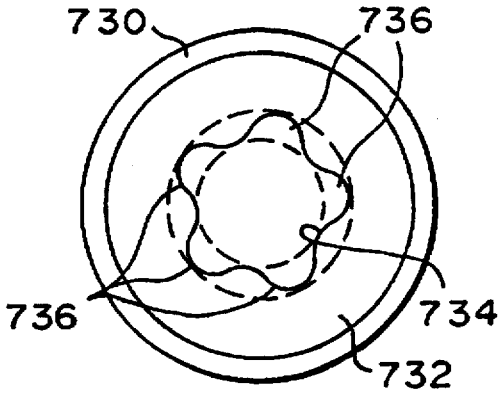

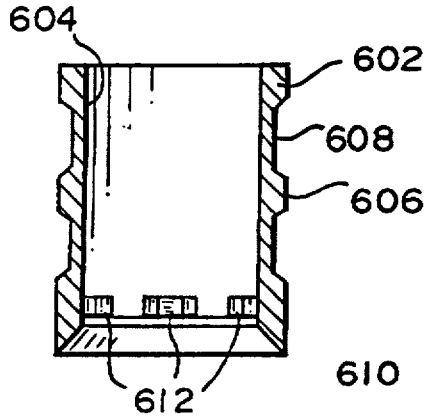
FIG. 16A
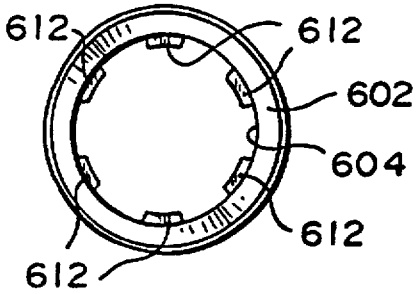
FIG. 16B
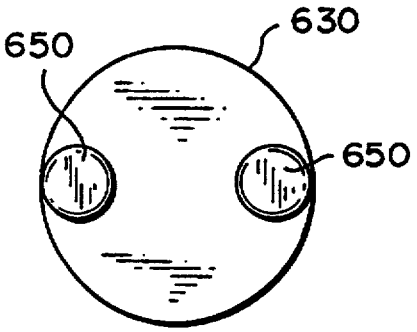
FIG. 17
FIG. 18
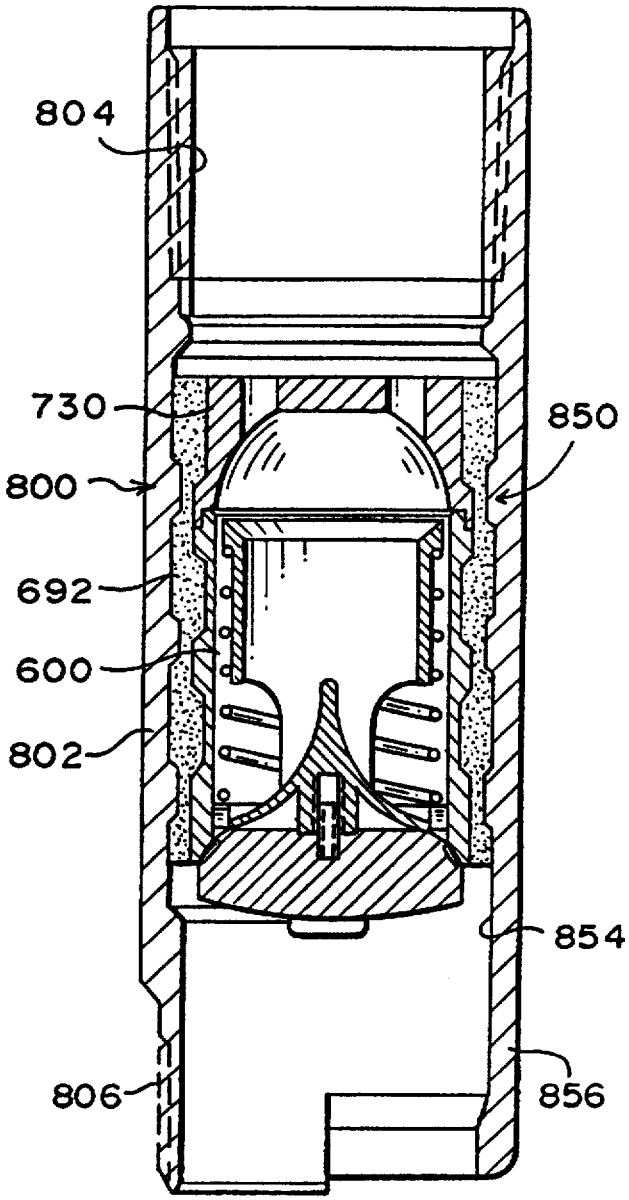

WELLBORE VALVE

RELATED APPLICATIONS

This is a continuation-in-part of U.S. application Ser. No. 08/519,503 filed on Aug. 25, 1995 and issued as U.S. Pat. No. 5,511,618 on Apr. 30, 1996, which is a continuation of U.S. application Ser. No. 283,404 filed on Aug. 1, 1994 and issued as U.S. Pat. No. 5,450,903 on Sep. 19, 1995. The disclosures of each of these cited applications is incorporated herein for all purposes in their entirety. This application claims priority from United Kingdom Application Ser. No. 9405679 filed on Mar. 22, 1994.

BACKGROUND OF THE INVENTION

This invention relates to a fill valve for use in the construction of oil and gas wells.

FIELD OF THE INVENITON

During the construction of oil and gas wells a borehole is drilled to a certain depth. The drill string is then removed and casing inserted. The annular space between the outside of the casing and the wall of the borehole is then conditioned for cementing by pumping conditioning fluid down the casing. The conditioning fluid flows radially outwardly from the bottom of the casing and passes upwardly through the annular space where it entrains debris and carries it to the surface. Finally, cement is pumped downwardly through the casing, squeezes radially outwardly from the bottom of the casing and passes upwardly into the annular space where it sets.

Conventionally a fill valve is fitted on the bottom of the casing or close to the bottom. The fill valve inhibits fluid entering the casing from the bore but permits fluid to flow from the casing into the borehole. The fill valve is normally incorporated in a float shoe or a float collar, a float shoe being fitted on the bottom of the casing whilst a float collar is incorporated between two lengths of casing.

At the present time certain of applicants' float valves comprises a tubular housing accommodating a valve member which is slidably mounted in the tubular housing. The valve member is generally mushroom shape having a head which is biased upwardly against a valve seat by a spring circumjacent the stem of the valve member. Whilst this arrangement works quite acceptably, the rate at which fluid, for example mud, conditioning fluid and cement, can flow through the flow valve is limited by the relatively small flow area between the radial circumference of the head of the valve member and the inside of the tubular housing.

The object of at least preferred embodiments of the present invention is to provide a fill valve which, when open, will allow freer passage of fluids therethrough.

SUMMARY OF THE INVENTION

According to the present invention there is provided a fill valve comprising a tubular housing accommodating a valve member which is biased towards a closed position, characterized in that said valve member comprises a head, a tubular portion and at least one window in said tubular portion, the arrangement being such that, in use, when said fill valve is open, fluid can flow from a casing, through said tubular portion and exit via said at least one window.

Preferably, said tubular portion has at least two windows disposed in the periphery of said tubular portion.

Adventageously, said valve member is provided with a deflector for deflecting fluid entering said tubular portion towards said at least one window.

Preferably, said deflector is designed to inhibit turbulence in the fluid as it passes through the fill valve.

In a particularly preferred embodiment said tubular portion is provided with two windows which are disposed opposite one another and said deflector extends from said head into said tubular portion.

In one embodiment, the head is arranged to seat on the bottom of the tubular housing in another embodiment the head has a bevelled surface adapted to seat on a correspondingly bevelled valve seat in the tubular housing, optionally with the assistance of a sealing ring.

Conveniently, a coil spring is used to bias the valve member to a closed position. The coil spring may be mounted circumjacent the tubular portion of the valve member and arranged to act between a flange on the tubular portion of the valve member and a shoulder formed in the tubular housing.

If desired the fill valve may include an attachment connected to said valve member, said attachment being adjustable to maintain said fill valve in a partially open position.

Preferably, said attachment comprises a spider having at least one leg which radiates outwardly from a hub, and a member which extends through said hub and engages said valve member, the arrangement being such that the opening of said fill valve may be adjusted by rotation of said member.

The present invention also provides a float collar provided with a fill valve in accordance with the invention and a float shoe provided with a fill valve in accordance with the invention.

For a better understanding of the present invention reference will, now be made, by way of example, to the accompanying drawings, in which:

BRIEF DESCRIPTION OF THE DRAWINGS

FIG. 12 is a side cross-section view of a wellbore valve according to the present invention.

FIG. 13A is a side cross-section view of a valve member of the valve of FIG. 12. FIG. 13B is a side view of the valve member of FIG. 13A. FIG. 13C is a bottom view of the valve member of FIG. 13C.

FIG. 14A is a side cross-section view of a ball seat retainer sub according to the present invention. FIG. 14B is a cross-section view along line 14B—14B of FIG. 14A.

FIG. 15A is a side cross-section view of a top member for a valve according to the present invention. FIG. 15B is a top view of the top member of FIG. 15A.

FIG. 16A is a side cross-section view of a body of the valve of FIG. 12. FIG. 16B is a bottom view of the body of FIG. 16A.

FIG. 17 is an end view of a valve seat member of the valve of FIG. 12.

FIG. 18 is a side cross-section view of a float apparatus according to the present invention.

DETAILED DESCRIPTION OF THE PREFERRED EMBODIMENTS

Figure 1:
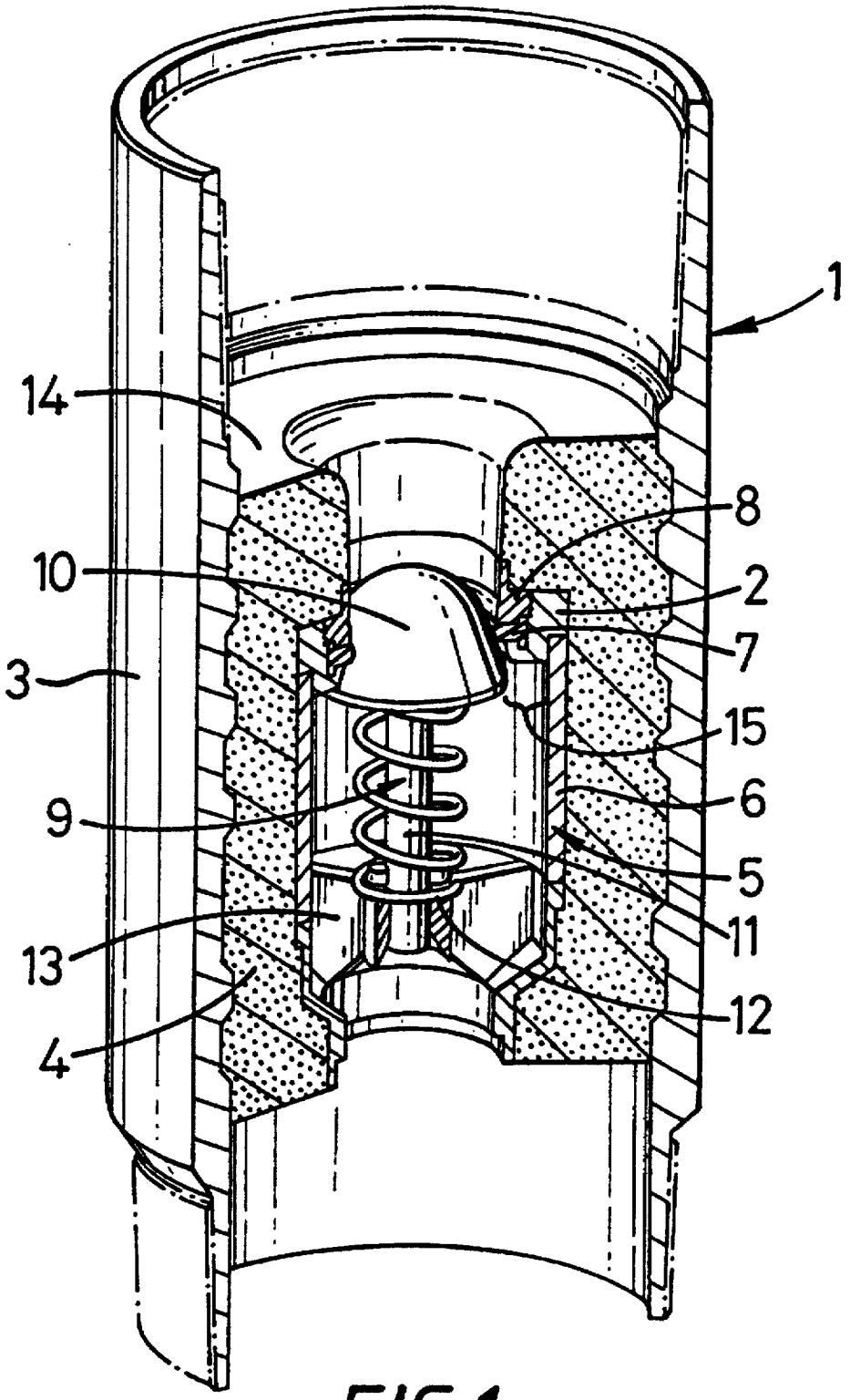
FIG. 1 PRIOR ART
FIG. 1 is a sectional view of one of the applicants float collars incorporating a known fill valve.

Referring to FIG. 1 of the drawings, there is shown one of applicants current float collars which is generally identified by reference numeral 1.

The float collar 1 comprises a fill valve 2 which is mounted in a short length of casing 3 by an annulus of high density cement 4.

The fill valve 2 comprises a tubular housing 5 including a cylindrical portion 6 and a valve seat 7 supported by a plate 8.

A valve member 9 is accommodated in the tubular housing 5. The valve member 9 is mushroom shaped and comprises a head 10 and a stem 11.

The head 10 is biased against the valve seat 7 by a light spring 12 which is disposed circumjacent the stem 11 and acts between the head 10 and a spider 13.

In use, the float collar 1 is mounted in a length of casing towards the bottom thereof. Once the casing is in position mud is pumped down the casing 3. The mud flows through the fill valve 2 and then passes radially outwardly from the bottom of the casing 3 and upwardly through an annulus between the casing 3 and the well-bore. The mud carries debris to the surface. Typically mud is passed through the fill valve 2 for several hours. Conditioning fluid (usually referred to as "spacer) is then pumped down the casing. The conditioning fluid helps remove the mud and contains chemicals which help the cement adhere to the casing.

After conditioning a charge of cement is pumped down the casing between a top plug and a bottom plug in the conventional manner. After the bottom plug seats on the upper surface 14 of the float collar 1 increasing pressure is applied to the top plug until a bursting disk in the bottom plug ruptures and permits the cement to flow downwardly into the float collar 1. The pressure applied to the cement by the top plug is transmitted to the head 10 of the valve member 9 which moves downwardly away from valve seat 7 thereby permitting the cement to pass through the fill valve 2.

When the top plug contacts the bottom plug no further cement passes through the fill valve. Pressure is then released on the top plug, the fill valve acting to inhibit cement flowing upwardly inside the casing. After the cement has set the top plug, bottom plug, fill valve and any cement below the fill valve are drilled out.

The flow of conditioning fluid and cement through the fill valve 2 is limited by the flow area between the perimeter of the head 10 of the valve member 9 and the cylindrical portion 6 of the tubular housing 5, i.e. the annulus having the width 15.

Figure 2:
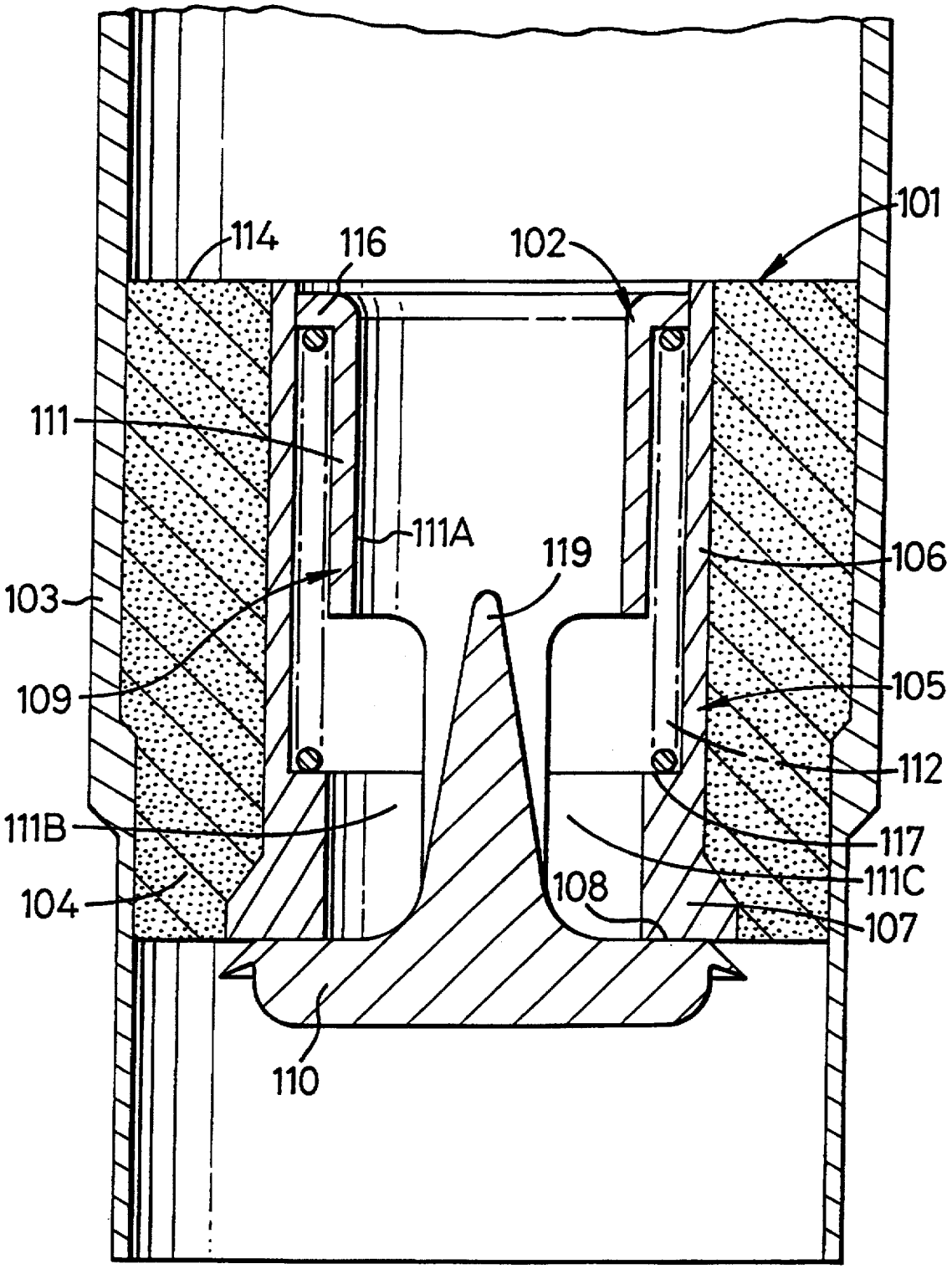
FIG. 2 is a cross-sectional view of one embodiment of a float collar incorporating a fill valve in accordance with the present invention in its closed position.
Figure 3:
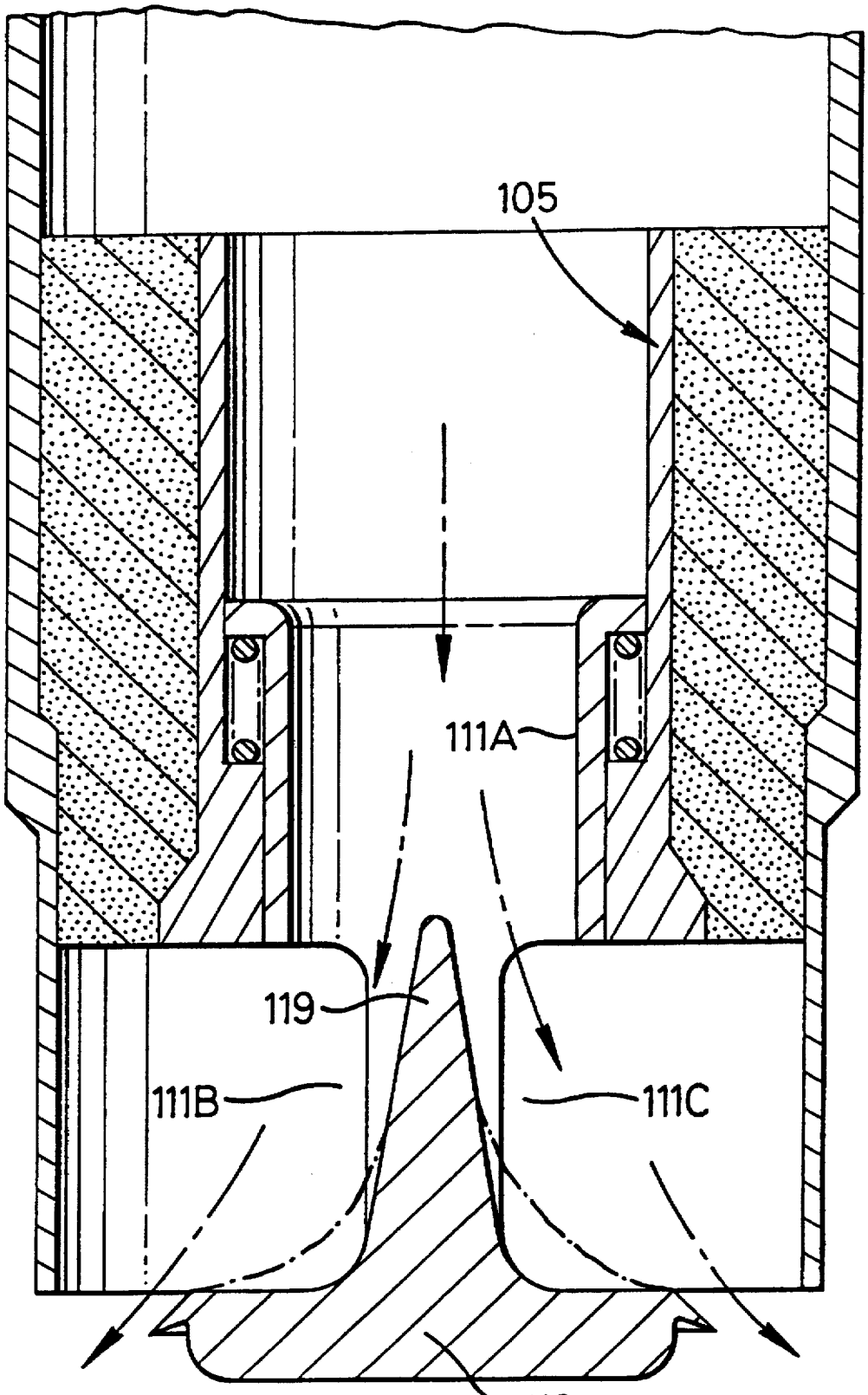
FIG. 3 is a view similar to FIG. 2 but showing the fill valve in its open position.

Referring now to FIGS. 2 and 3 of the drawings there is shown a float collar which is generally identified by reference number 101.

The float collar 101 comprises a fill valve 102 which is mounted in a short length of casing 103 by an annulus of high density cement 104.

The fill valve 102 comprises a tubular housing 105 including a cylindrical portion 106 and a valve seat 107 having a seating surface 108.

A valve member 109 is accommodated in the tubular housing 105. The valve member comprises a head 110 and a stem 111 which comprises a tubular portion 111A provided with windows 111B and 111C.

The head 110 is biased against the valve seat 107 by a light spring 112 which is disposed circumjacent the stem 111 and acts between a flange 116 on the top of the tubular portion 111A and a shoulder 117 formed in the tubular housing 105 between the cylindrical portion 106 and the valve seat 107.

In use the float collar 101 is mounted in a length of casing towards the bottom thereof. Once the casing is in position mud is pumped down the casing. The mud displaces the valve member 109 downwardly from valve seat 107 thereby permitting the mud to pass through the fill valve 102. The mud then passes downwardly to the bottom of the casing, radially outwardly and then upwardly in the annular space between the casing and the wellbore. The mud removes debris from the annular space and carries it to the surface. After several hours the flow of mud is stopped and conditioning fluid is pumped down the casing to prepare the annulus for cementing.

After conditioning a charge of cement is pumped down the casing between a top plug and a bottom plug in the conventional manner. After the bottom plug seats on the upper surface 114 of the float collar 101 increasing pressure is applied to the top plug until a bursting disk in the bottom plug ruptures and permits the cement to flow downwardly into the float collar 101. The pressure applied to the cement by the top plug is transmitted to the head 110 of the valve member 109 which moves downwardly away from valve seat 107 thereby permitting the cement to pass through the fill valve 102.

As shown in FIG. 3 the cement passed through the tubular portion 111A and exits via windows 111B and 111C which are disposed opposite one another.

A deflector 119 is provided and extends upwardly from the head 110 into the tubular portion 111A. The deflector 119 guides the cement towards the windows 111B and 111C.

In a prototype the fill valve 102 shown in FIGS. 2 and 3 had a flow area significantly greater than the fill valve 2 shown in FIG. 1 although the inner diameter of the cylindrical portions 6 and 106 of each fill valve 2, 102 was substantially equal.

Figure 4:
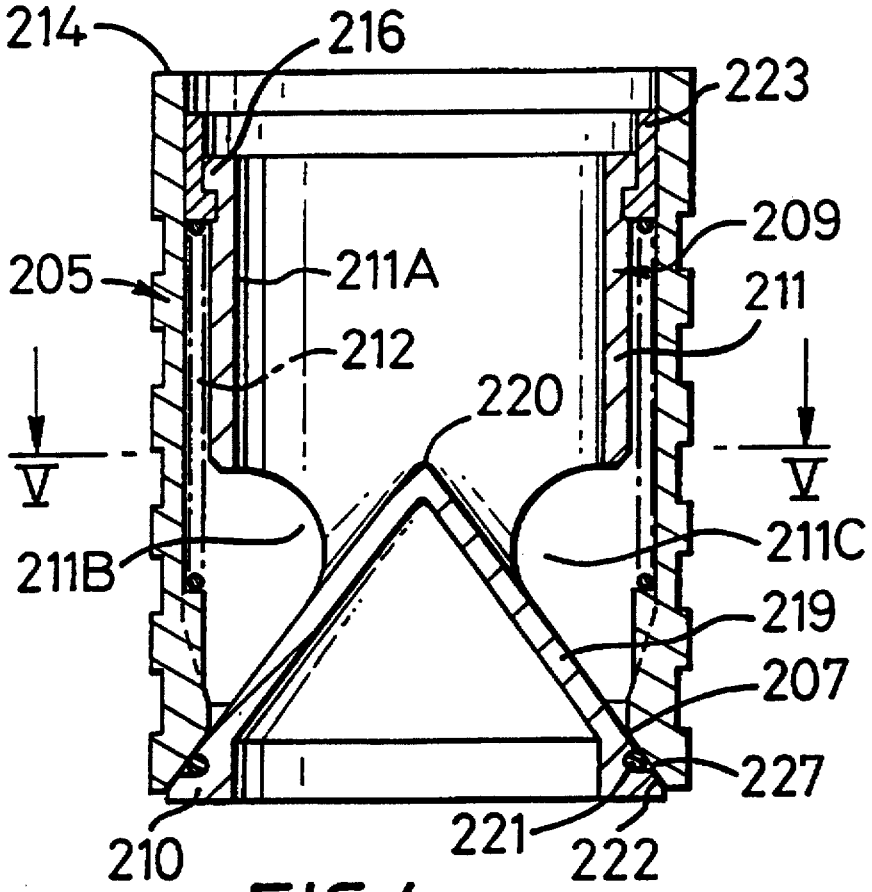
FIG. 4 is a sectional view of a second embodiment of a fill valve in accordance with the invention.
Figure 5:
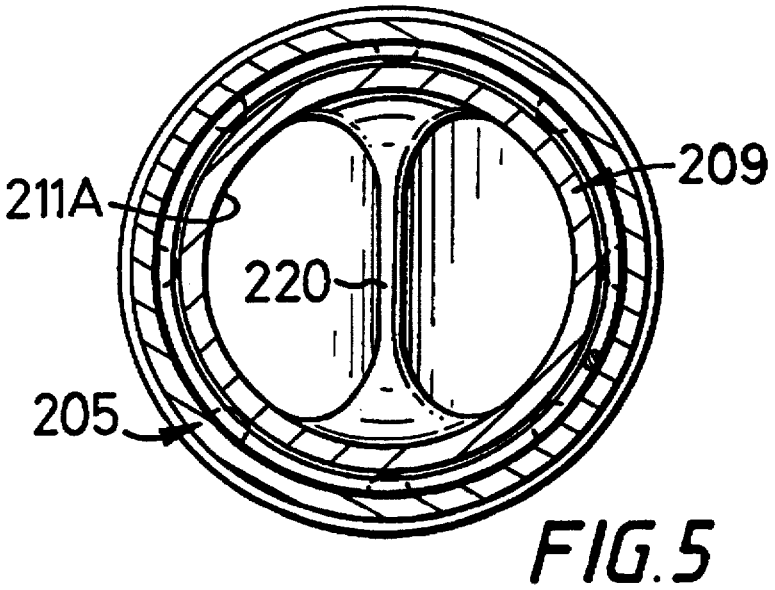
FIG. 5 is a view on line V—V of FIG. 4.

The embodiment show in FIGS. 4 and 5 is generally similar to that show in FIGS. 2 and 3 with the exception that the deflector 219 is inclined uniformly from the inside of the valve seat 207 to an apex 220 on the centreline of the valve member 209. In addition the valve seat 207 is bevelled and is arranged to receive an O-ring seal 221 mounted on a correspondingly bevelled surface 222 of the head 210 of the valve member 209. A further difference is that a ring 223 is attached to the stem 211. The ring 223 is recessed below the upper surface 214 of the float collar to ensure that valve member 209 does not start to open as soon as the bottom plug engages the upper surface 214 of the float collar. This arrangement also ensures that the stem 211 can rise freely at the end of cementation to close the fill valve.

Figure 6:
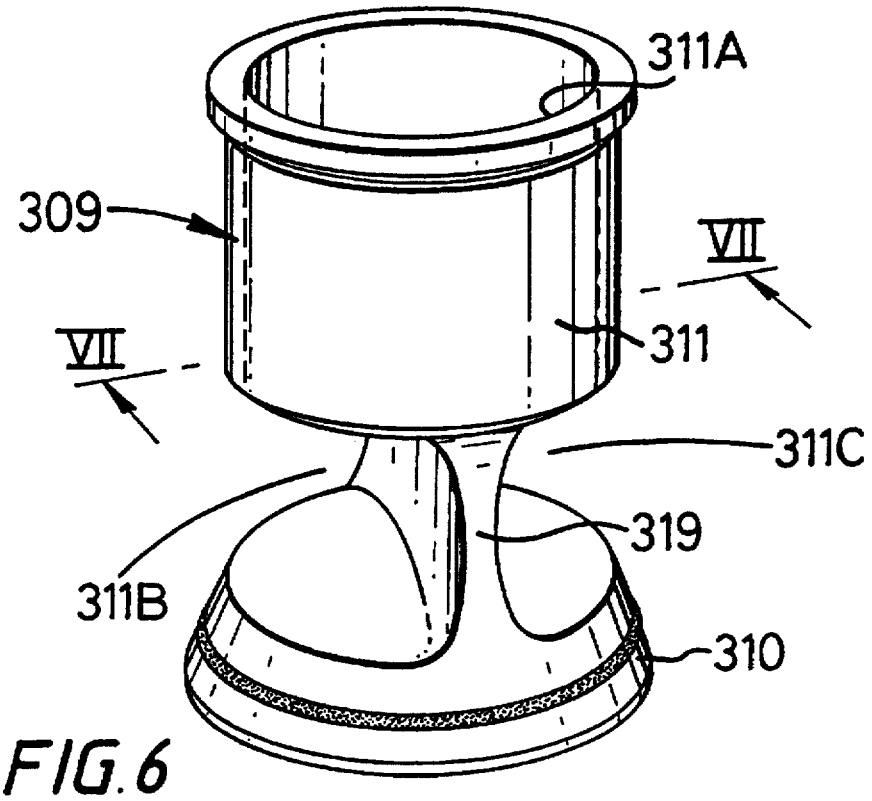
FIG. 6 is a perspective view of a valve member forming part of a third embodiment of a fill valve in accordance with the present invention.
Figure 7:
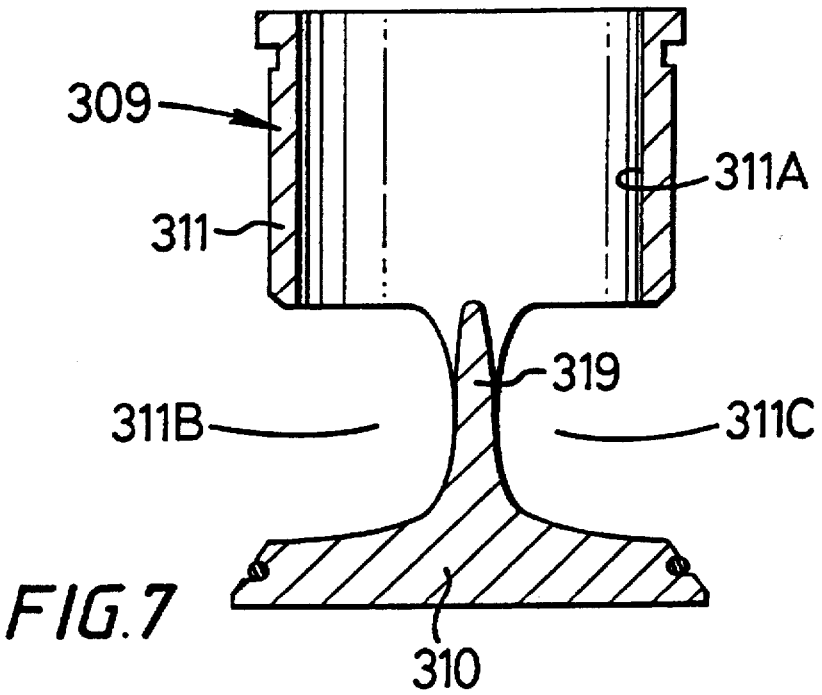
FIG. 7 is a view taken on line VII—VII of FIG. 6.

FIGS. 6 and 7 show a further embodiment using a relatively small deflector 319.

Figure 8:
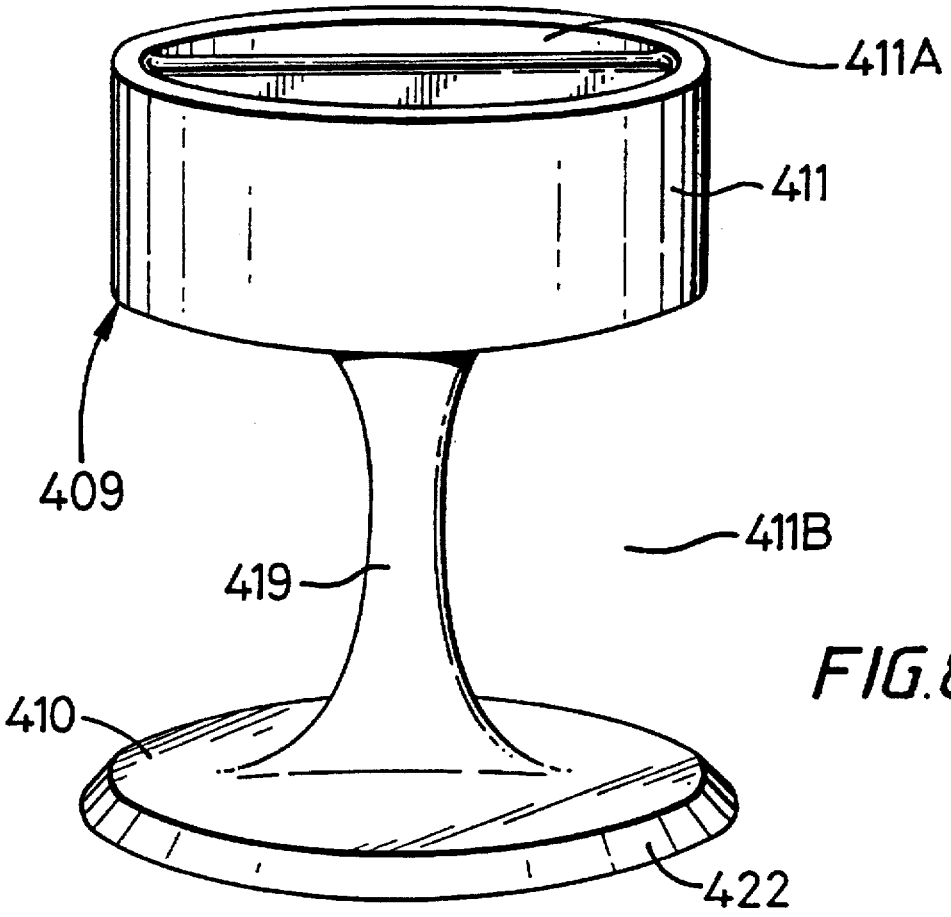
FIG. 8 is a perspective view of a valve member forming part of a fourth embodiment of a fill valve in accordance with the invention.
Figure 9:
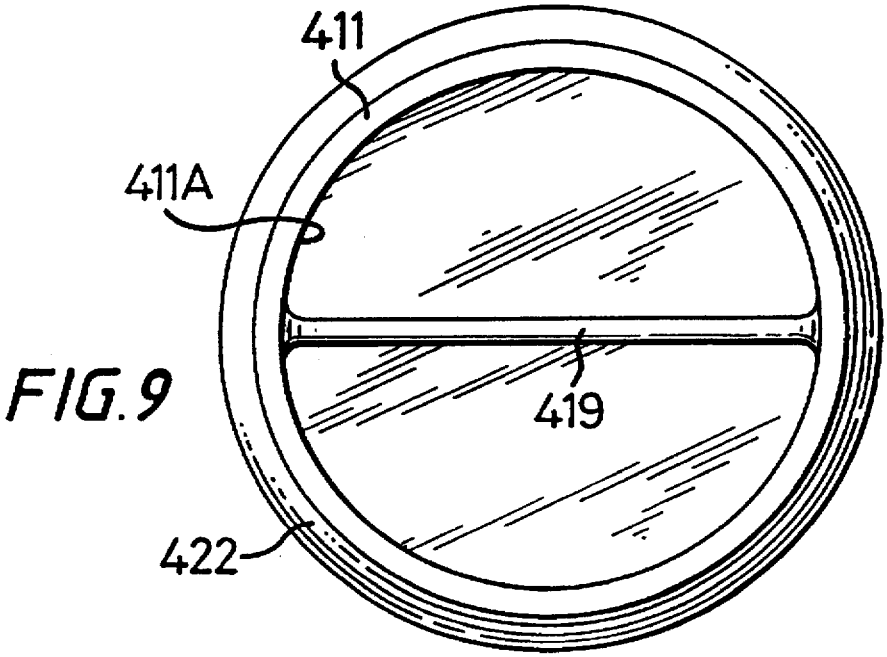
FIG. 9 is a top plan view of the valve member shown in FIG. 8.

FIGS. 8 and 9 show a valve member 409 which comprises a tubular portion 411A provided with a single window 411B. The head 410 has a bevelled surface 422 which, unlike the embodiment shown in FIGS. 4 and 5, is not provided with an O-ring seal. The head 410 is attached to the tubular portion 411A via deflector 419.

Figure 10:
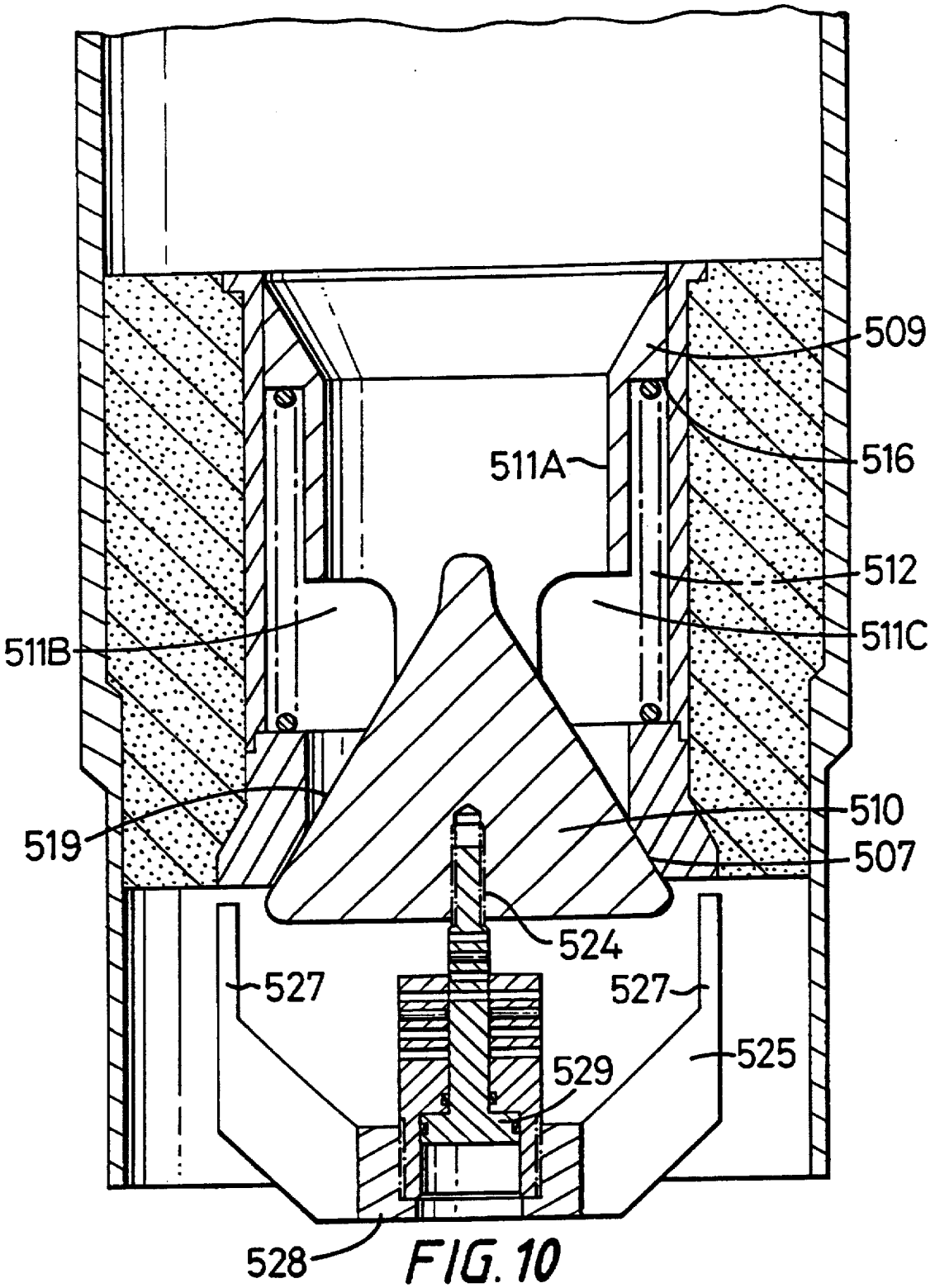
FIG. 10 is a vertical cross-section through a fifth embodiment of a fill value in accordance with the invention with an attachment in an inoperative position.
Figure 11:
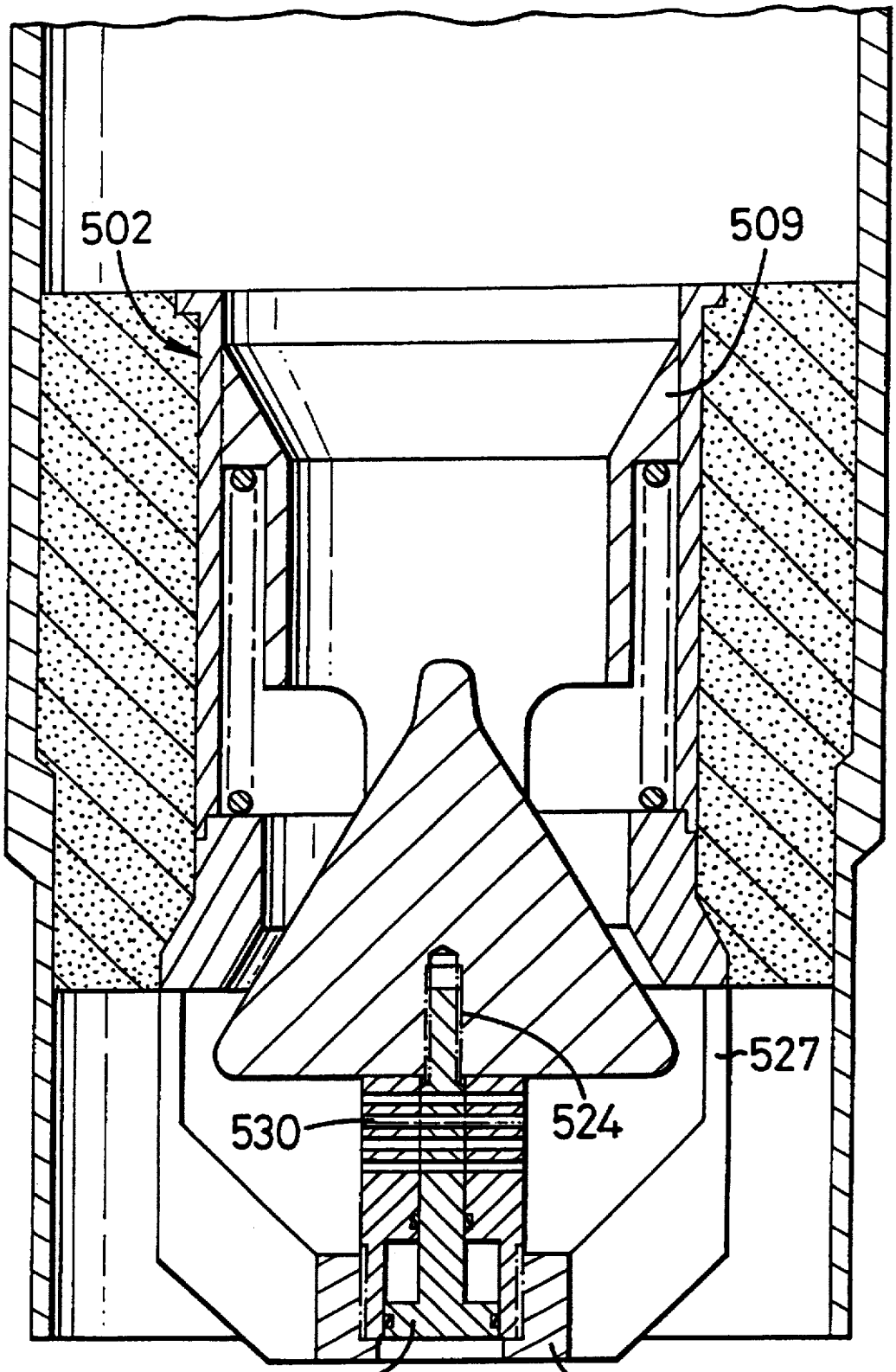
FIG. 11 is a view similar to FIG. 10 showing the fill valve with the attachment in an operative position.

In the embodiment shown in FIG. 10, the head 510 of the valve member 509 is provided with a threaded bore 524 into which is screwed an attachment 525. The attachment 525 comprises a spider having four legs 527 which radiate outwardly from a hub 528.

A bolt 529 extends through the hub 528 and is screwed into the threaded bore 524.

When lowering a string of casing into a wellbore it is sometimes desirable to be able to allow liquid from the wellbore to flow into the casing at a controlled rate. For this purpose a shear pin 530 is first inserted through a bore extending through the hub 528 and the bolt 529. The hub 529 is then rotated so that the bolt 529 enters the threaded bore 524. Rotation is continued until the attachment 525 bears against the valve seat 507 and the fill valve is opened by the desired amount.

In use, the valve member 509 is opened by the desired amount and the casing lowered down the wellbore. When the pressure on the bottom of the head 510 of the valve member 509 reaches a predetermined level the shear pin 530 breaks and the fill valve closes.

During a cementing operation the valve member 509 is displaced downwardly in the previously described manner to allow fluid to pass through the valve 502.

Various modifications to the embodiments described portion is of circular cross-section it could also be polygonal; for example square, or oval although circular is much preferred. Whilst the head 210 of the valve member 209 shown in FIGS. 6 and 7 uses an O-ring seal 221 this may be omitted in certain circumstances. Alternatively, the head 210 may comprise a resilient sealing material.

Our most recent work indicates that the deflector should be shaped to inhibit turbulence in the fluid as it passes through the fill valve. This reduces cavitation which, in turn, reduces errosion and enhances the longevity of the fill valve. Referring now to FIG. 12–13C and 16A–17, a fill valve 600 according to the present invention has a body 602 with a fluid flow channel or bore 604 therethrough from one end to the other. A ridge 606 and valleys 608 on the exterior of the body 602 facilitate cementing of the body 602 in place in float equipment.

A valve member 620 with a fluid flow bore 622 is movably positioned in the body 602. A spring 640 with a top end biased against a shoulder 642 of the valve member 620 and a bottom end biased against a plurality of fingers 612 projecting inwardly from the body 602 normally urges the valve member 620 upwardly so that a seal 632 around a seat member 630 is held in sealing contact with a bottom seat 610 of the body 602, thereby preventing fluid, etc. from flowing from below the valve 600 up through the bore 604.

Preferably in this embodiment the body 602 and valve member 620 are sized and configured so that a flow channel 646 is defined between the valve member 620 and the body 602. Fluid from above the valve 600 flows down into the channel 646 and past the spring 640 to dislodge debris and solids and clean the spring 640 and area therearound.

The valve member 620 has a fluid deflector 628 (like the previously described deflectors) and a plurality of windows 648 adjacent the deflector provide a fluid flow path for fluid flowing from above when the valve is open.

The valve seat member 630 is secured to the deflector 628, e.g. by known epoxy adhesives and by a stud 634 that has one end friction-fitted and/or glued in a recess 636 of the deflector 628 and one end in a recess 638 of the seat member 630. One or more feet 650 on the bottom of the seat member 630 prevent the seat member 630 from seating against another item disposed below the valve 600.

As shown in FIGS. 13A–13C a plurality of ribs 652 support the deflector 628. A fluid pressure equalization port 644 in fluid communication with chambers 646 in the ribs 652 prevent collapse of the hollow deflector 628 due to a hydrostatic head of fluid pressure to which the deflector 628 is subjected.

FIGS. 14A and 14B show a ball seat retainer sub 700 according to the present invention with a body 702, a fluid flow bore 704 from one end to the other, and a ball retainer 710. The ball retainer 710 has a body 712, a flexible rubber ball receiver 714 (through which a ball of desired size may be pumped) and a ball trap 716 (through which the ball may also be pumped). The ball retainer 710 is held in the body 702, e.g. by an amount of cement 706.

As shown in FIG. 14B, the ball trap 716 has a plurality of flow slots 718. If a ball B is pumped through the sub 700 and then fluid under pressure from the opposite direction pushes the ball upwardly, it encounters the ball trap 716 which prevents the ball from moving further upwardly and, simultaneously, lets fluid flow upwardly through the slots 718 since the ball does not block all the slots.

FIGS. 15A and 15B show an anti-rotation top member 730 with a body 732 and a fluid flow bore 734 for use with valves and float equipment as described herein (e.g. with the apparatus shown in FIG. 18). The body 732 is molded with a plurality of indentations or channels 736 (or they are formed therethrough by drilling or milling) which are sized, positioned and configured to anti-rotatively receive a corresponding nose of another device, e.g. a plug. The channels 736 may extend through the body 732 as shown or may terminate within the body 732.

FIG. 18, left side, shows a float collar 800 according to the present invention with a body 802 having a lower threaded end 806, a bore 804, a valve 600 as previously described (but with a body 692), and an anti-rotative top member 730.

FIG. 18, right side, shows a float collar 850 according to the present invention with a body 852, a bore 854, a lower end 856, a valve 600 as previously described, and an anti-rotative top member 730.

A ball seat retainer sub like the sub 700 may be used above a float collar according to this invention, e.g. one or more joints above a float collar.

In a typical operation of apparatus as shown in FIGS. 12–18, the bottom of a string is connected to a joint which is in turn connected to a float collar (each with a valve like the valve 600). The casing string (plurality of hollow pieces of casing joined end-to-end) is then run to the bottom of the wellbore. Typically circulation in a wellbore is done prior to cementing the casing in place to insure the annulus is clean, e.g. until mud at the bottom of the wellbore has been circulated to the surface. Then a spacer fluid is pumped down the casing, a bottom plug is launched, cement is pumped down, a top plug is pumped down, and the bottom plug lands on the float collar. At a sufficient pressure, a disc or diaphragm in the bottom plug bursts and the cement flows from the casing up into the annulus. When the top plug lands on the bottom plug, cement flow ceases. The valve(s) 600 prevent flow back into the casing, e.g. u-tubing, when the cement weighs more than the fluid used to displace the top plug.

In another embodiment the valve body 602 has an upper shoulder and the valve member 620 has two shoulders so that two springs urge the valve normally closed; one spring, an upper spring biased against a top shoulder of the valve member and the shoulder of the valve body; and the second spring, a lower spring, biased against a lower shoulder of the valve member and the fingers of the valve body.

We claim:

1. A fill valve for use in cementing operations in the construction of oil and gas wells, the fill valve comprising a tubular housing having a valve seat, a valve member slidably mounted in the tubular housing, spring means biasing the valve member towards a closed position, the valve member comprising a head engageable with the valve seat of the tubular housing to close the valve, a tubular portion, at least one window in the tubular portion, so that fluid pumped through the tubular portion displaces the valve member relative to the tubular housing to open the fill valve and exit via the at least one window, the tubular housing having a first end and a second end, the valve seat at the first end, the tubular portion having a first end and a second end, the head adjacent the first end of the tubular portion, the second end of the tubular portion adjacent the second end of the tubular housing, and a space between the tubular housing and the tubular portion, the spring means in the space, the space disposed so that the a portion of fluid flowing down into the housing flows through the space and past the spring means to dislodge debris and to clean the spring means.

2. The fill valve of claim 1 further comprising a deflector mounted at a bottom of the tubular portion for deflecting fluid the tubular ,portion towards the at least one window, and the deflector having a plurality of spaced-apart ribs therein for supporting the deflector.

3. The fill valve of claim 2 wherein the plurality of ribs define a plurality of chambers therebetween and the fill valve further comprising a fluid pressure equalization port in fluid communication with the plurality of chambers for preventing collapse of the deflector due to a hydrostatic head of fluid pressure thereon.

4. The fill valve of claim 1 wherein the spring means comprises a coil spring biasing the valve member against the valve seat, the spring is mounted circumjacent the tubular portion of the valve member, the tubular portion has an upper flange, and the tubular housing has a plurality of lower spaced-apart fingers projecting thereinto and the coil spring acts between the upper flange of the tubular portion and the plurality of lower spaced-apart fingers.

5. The fill valve of claim 1 wherein the tubular housing has a plurality of ridges projecting from an exterior surface thereof to facilitate cementing of the fill valve within another item.

6. A fill valve for use in cementing operations in the construction of oil and gas wells, which fill valve comprises a tubular housing having a valve seat, a valve member slidably mounted in said tubular housing, and spring means biasing said valve member towards a closed position, wherein said valve member comprises a head engageable with said valve seat of said tubular housing to close the valve, a tubular portion and at least one window in said tubular portion, so that fluid pumped through said tubular portion displaces said valve member relative to said tubular housing to open the fill valve and exit via said at least one window, a fluid deflector mounted at a bottom of the tubular portion for deflecting fluid entering the tubular portion towards the at least one window, and the head secured to and below the deflector.

7. The fill valve of claim 6 wherein the head is secured to the deflector with a stud having one end secured within the deflector and another end secured in the head.

8. The fill valve of claim 6 further comprising at least one foot member projecting from a bottom of the head for preventing the bottom of the head from seating on another item disposed below the fill valve.

9. A float collar for use in wellbore operations, the float collar comprising a hollow body with a top end and a bottom end, a fill valve mounted in the hollow body, the fill valve comprising a tubular housing having a valve seat, a valve member slidably mounted in said tubular housing, and spring means biasing said valve member towards a closed position, wherein said valve member comprises a head engageable with said valve seat of said tubular housing to close the valve, a tubular portion and at least one window in said tubular portion, so that fluid pumped through said tubular portion displaces said Valve member relative to said tubular housing to open the fill valve and exit via said at least one window.

10. The float collar of claim 9 further comprising an antirotation member mounted in the body above the fill valve.

11. The float collar of claim 9 further comprising a ball seat retainer sub connected at the top end of the hollow body, the ball seat retainer sub comprising a hollow body member With a fluid flow bore therethrough, a ball seat retainer secured in the fluid flow bore of the hollow body member, the ball seat retainer having a flexible retainer body and a ball trap mounted therein, the ball trap having a plurality of slots therethrough, the flexible retainer body having an opening therethrough closable by a ball and through which the ball is pumpable, and the ball pumpable through the ball trap, the ball trap preventing subsequent upward passage of the ball therethrough while permitting fluid flow through the ball seat retainer sub.

12. A method for cementing the annulus between an exterior surface of a casing string in a wellbore and an interior surface of the wellbore, the method comprising running a hollow tubular string into the Wellbore, the hollow tubular string having a float collar at a bottom thereof, the float collar comprising a fill valve for use in cementing operations in the construction of oil and gas wells, which fill valve comprises a tubular housing having a valve seat, a valve member slidably mounted in said tubular housing, and spring means biasing said valve member towards a closed position, wherein said valve member comprises a head engageable with said valve seat of said tubular housing to close the valve, a tubular portion and at least one window in said tubular portion, so that fluid pumped through said tubular portion displaces said valve member relative to said tubular housing to open the fill valve and exit via said at least one window, circulating fluid down through the hollow tubular string and through the float collar to clean the annulus, pumping a spacer fluid down the casing, launching a bottom plug into the hollow tubular string to close off flow through the float collar, the bottom plug having a ruptureable closure member therein, pumping cement down into the float collar through the hollow tubular string, launching a top plug down the hollow tubular string on top of the cement therein, bursting the ruptureable closure member of the bottom plug permitting the cement to flow through the float collar to open the fill valve and flow therefrom up into the annulus, the fill valve preventing the cement from flowing back into the hollow tubular string.

13. The method of claim 12 wherein an antirotation member is mounted in the body above the fill valve, the bottom plug contacting the anti-rotation member anti-rotatively.

* * * * *